United States Patent [19]

Urdal

[11] 4,129,019

[45] Dec. 12, 1978

[54] CARTRIDGE FOR A LOCKSET

[75] Inventor: Jan Urdal, Hayward, Calif.

[73] Assignee: Schlage Lock Company, San Francisco, Calif.

[21] Appl. No.: 796,967

[22] Filed: May 16, 1977

[51] Int. Cl.[2] ..... E05B 59/04; E05B 63/04

[52] U.S. Cl. ..... 70/107; 70/462

[58] Field of Search ..... 70/107, 108, 109, 110, 70/111, 118, 119, 120, 462; 292/34, 37

[56] References Cited

U.S. PATENT DOCUMENTS

| | | | |
|---|---|---|---|
| Re. 26,667 | 10/1969 | Russell et al. | 70/107 X |
| 3,111,020 | 11/1963 | Garcia | 70/107 |
| 3,148,524 | 9/1964 | Yulkowski | 70/107 |
| 3,389,587 | 6/1968 | Russell et al. | 70/462 X |
| 3,910,613 | 10/1975 | Nolin | 70/107 X |
| 3,990,277 | 11/1976 | Mollich | 70/107 |
| 3,999,789 | 12/1976 | Maurits et al. | 70/107 X |

FOREIGN PATENT DOCUMENTS

| | | | |
|---|---|---|---|
| 834448 | 2/1970 | Canada | 70/107 |
| 1111402 | 10/1955 | France | 292/34 |
| 469170 | 4/1969 | Switzerland | 70/120 |
| 238359 | 8/1925 | United Kingdom | 292/37 |

*Primary Examiner*—Thomas J. Holko
*Attorney, Agent, or Firm*—Lothrop & West

[57] ABSTRACT

A cartridge for a lockset for a door having a primary rotatable spindle and a secondary rotatable spindle parallel thereto has a pair of identical cartridge plates disposed in abutment with each other and defining a space therebetween. There are openings in the plates adapted to receive portions of the spindles secured in position relative to the plates by fastenings engaging the spindle supports and going through the plates. Within the space is a slide confined to straight line motion by edge flanges on the plates. At one end the slide has symmetrical lugs adapted to engage projecting arms of a rocker lever surrounding and rotating with the primary spindle. At the other end the slide has a projecting lug adapted to engage an arm of a rotary lever connected to the secondary spindle. The cartridge is symmetrical about a longitudinal center line and so can be applied to the spindles either side first for right-hand and left hand doors.

6 Claims, 9 Drawing Figures

52
123
41
49
46
59
56
61
48
58
103
98
97
96
106
86
99
137
42
102
107
92
104
43
91
83
81
64
66
67
68
69
84
89
93
44
62
63
54
53
134
57
51
72
82
78
73
76
77
133
79
88
71
74
129
128
131
26
31
29
113
114
32

CARTRIDGE FOR A LOCKSET

BRIEF SUMMARY OF THE INVENTION

Two individual, standard lock devices, collectively referred to as a lockset, are utilized on a door panel in connection with the door frame. The lock devices, usually entirely independent of each other, are joined together by a cartridge device interengaging with the spindles of the individual locks. The cartridge contains mechanism for actuating both of the standard locks from one of the lock operators. The device is arranged to be easily installed with unchanged standard lock mechanisms and to be easily turned over to accommodate without adjustment or change left-hand or right-hand installations. The cartridge is relatively thin and can be unobtrusively applied to installations already in existence and to new installations.

DETAILED DESCRIPTION

Figure 1:
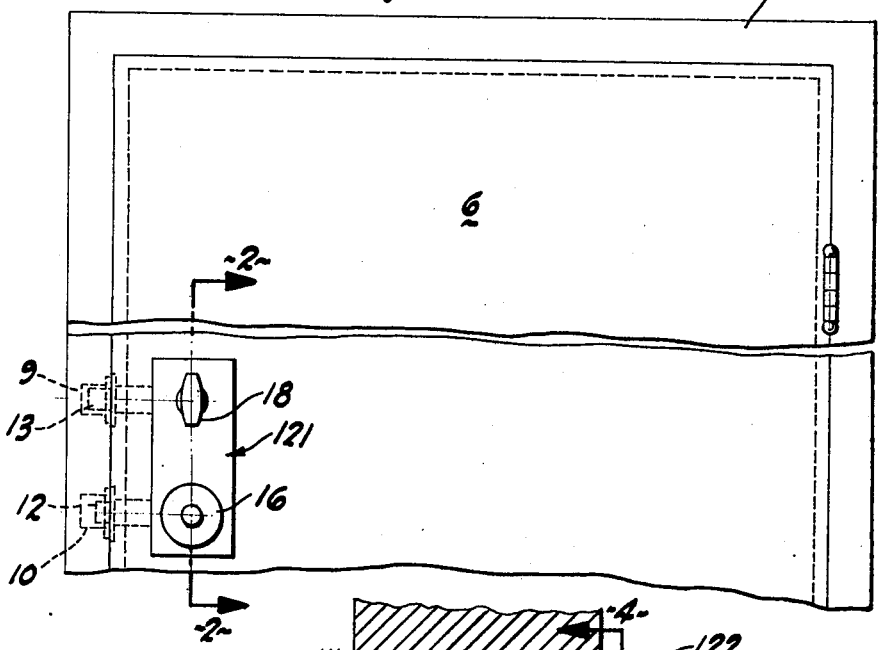
FIG. 1 is an elevation of a door and frame, portions being broken away, and showing the installational environment of the cartridge.
Figure 2:
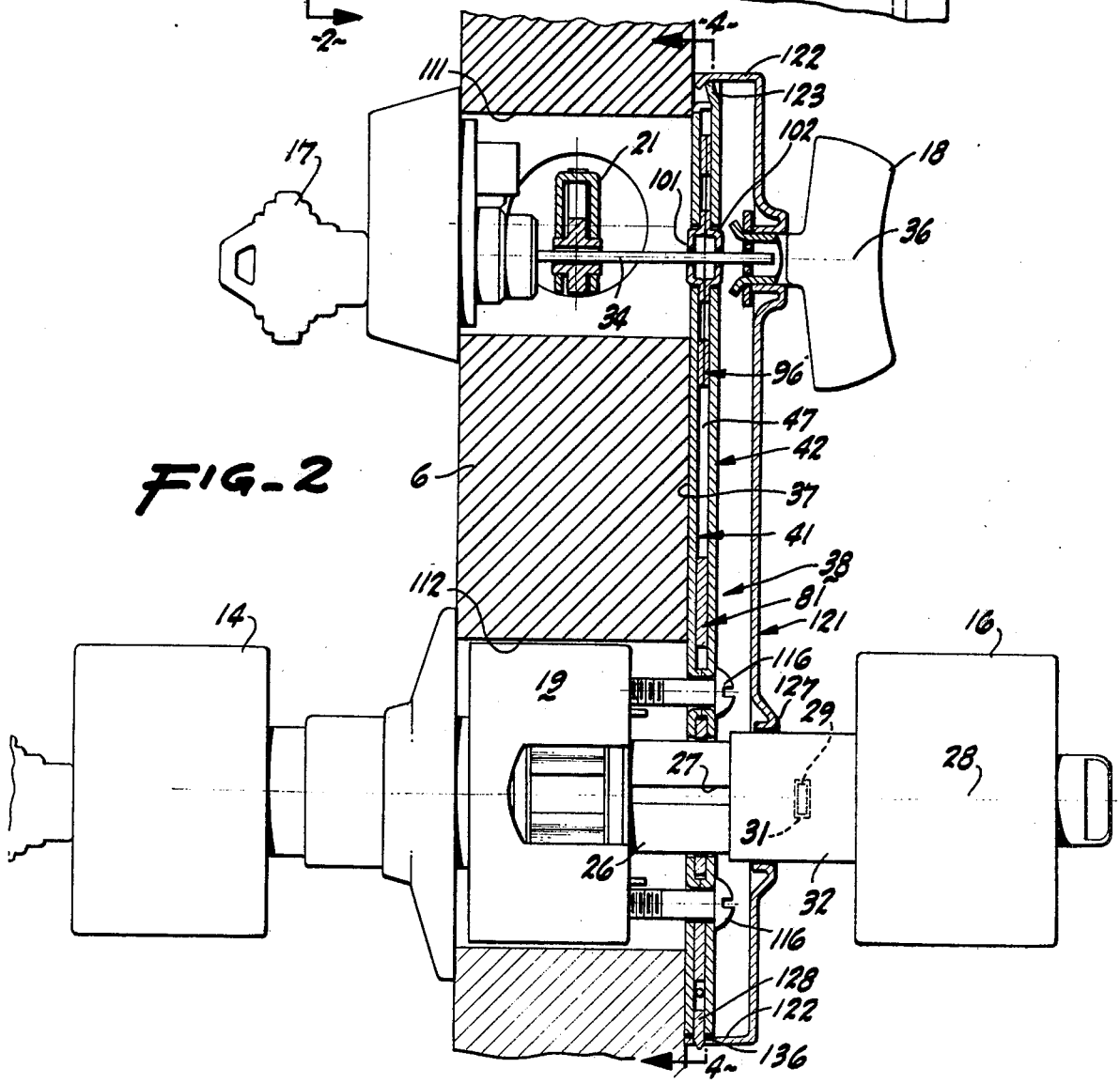
FIG. 2 is a cross-section, the plane of which is indicated by the line 2—2 of FIG. 1, but shown to a greatly enlarged scale.

The usual environment for the lockset cartridge is in connection with a door panel 6 mounted on hinges 7 in a door frame 8 in a surrounding wall. The frame is provided with one or more strike boxes 9 and 10 arranged to receive two bolts, a latchbolt 12, for example, and a deadbolt 13. In many installations the latchbolt 12 is provided with a keyed operator 14 on the exterior (FIG. 2) and an operator 16 on the interior. The deadbolt 13 is provided with a key actuator 17 on the exterior and a turn control 18 on the interior.

Particularly in accordance with this arrangement, the latchbolt mechanism 19 governed by the controllers 14 and 16 is a standard, independent lockset readily available and of a kind already installed on many door panels. Comparably, the mechanism 21 of the deadbolt structure controlled by the key 17 and by the operator 18 is itself a separate, standard mechanism as already installed in many door panels. Customarily there is no operating connection between the top and bottom controls such as the controls 16 and 18 on the interior of the door panel. This may result in difficulty under panic conditions. A person on the inside of the door meaning to get out quickly and turning the control 16 to retract the latchbolt does simply and only that. Many people, under such conditions, do not realize that the control 18 must also and separately be turned also to retract the deadbolt 13 in order to open the door panel.

To avoid this difficulty, yet to do so in a simple, inexpensive fashion and in a way that can often be utilized on installations already made as well as on future installations, there is provided the cartridge structure particularly disclosed herein. This is designed to be installed on the interior side of the door panel 6 and to serve as an interconnection between the controller 16 for the latchbolt and the controller 18 for the deadbolt. Rotation of the controller 16 by itself will retract both the latchbolt and the deadbolt. This function is valuable in a panic situation and has been accomplished in known locks but is done in a complicated and expensive fashion. Herein the aim is to utilize two standard lock mechanisms and to provide a simple, inexpensive, unobtrusive way of interconnecting them. Also, to keep inventories and the cost low, and to provide widespread adaptability and low-skill installation, it is arranged that the cartridge mechanism be readily used with locksets for left-hand installation as well as locksets for right-hand installation and without any alteration in the cartridge itself.

Figures 3, 9:
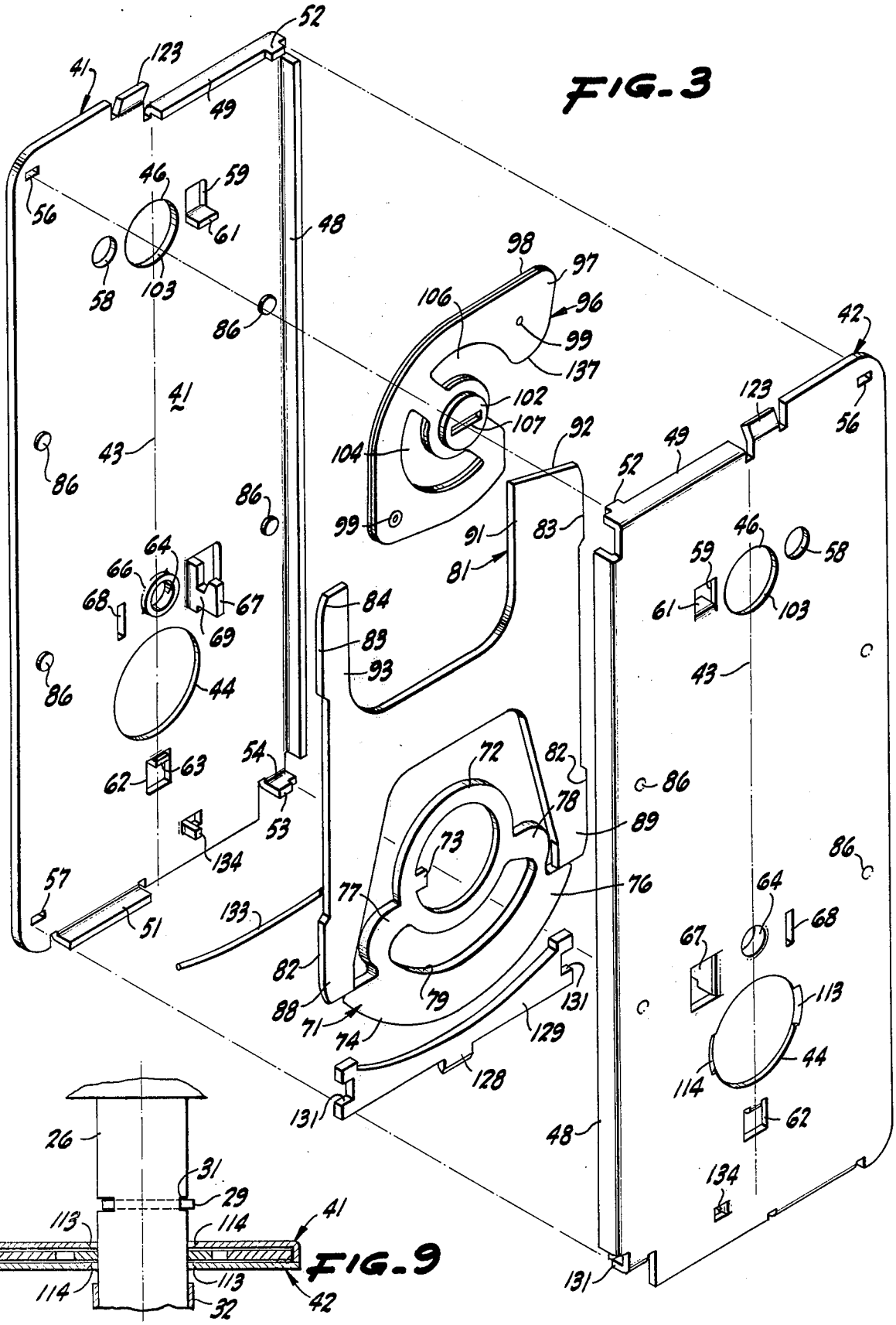
FIG. 3 is an isometric view of various parts of the cartridge mechanism shown in spaced or exploded position.
FIG. 9 is a fragmentary cross-section horizontally through the primary spindle showing the mode of application of the cartridge thereto.

In the standard latchbolt mechanism 19, there is customarily provided a cylindrical spindle 26 of usual form equipped with a slot 27 in the side wall thereof extending parallel to the rotational axis 28 of the lockset. Furthermore, the spindle 26 usually carries a spring-pressed detent 29 (FIG. 9) that projects radially beyond the spindle wall in order to interengage with an aperture 31 in the shank 32 of the operator 16. The operator 16 is initially applied to the spindle by being piloted thereon and then forced toward the panel along the axis 28. The edge of the shank 32 then rides over the detent 29, momentarily depressing the detent, which subsequently springs back outwardly into the aperture in the shank and thus holds the operator in place.

In a comparable fashion, the lock mechanism 21, a standard component, utilizes a secondary spindle 34 conveniently in the form of a flat driver bar of sufficient length to project from the face of the door panel 6 and effective when rotated about a secondary axis 36 to project and retract the deadbolt 13.

Pursuant to the present invention, the installation is made in substantially the usual way except that before the operator 16 is applied and when both spindles are exposed, there is provided against the inner face 37 of the door panel 6 a cartridge mechanism 38. This engages over and forms an appropriate interconnection between the spindles 26 and 34.

Included in the cartridge is a first cartridge plate 41 and a second cartridge plate 42. The plates 41 and 42 are separate and distinct, but they are particularly made identical in configuration. The plate 41, as a representative, is generally a rectangular, flat plate largely symmetrical about a longitudinal axis 43. Piercing the plate is an opening 44 large enough easily to accommodate the primary cylindrical spindle 26 for ready rotation and another opening 46 large enough to accommodate the secondary spindle 34 for rotation, the apertures 44 and 46 being spaced apart along the axis 43 at the proper distance to conform to the standard mounting of the two lock mechanisms.

The plates 41 and 42 are designed to be arranged with respect to each other so as to leave an intervening space 47 or volume. This is accomplished by providing on the plates along one edge an upturned edge flange 48 and also similar top and bottom flanges 49 and 51 respectively. Each of the edge flanges 48, 49 and 51 is of a dimension to provide the desired intervening space 47 when the two plates are superposed with the flanges of one abutting the surface of the other.

To make certain that the various openings and other features of the plates are in appropriate axial registry, the flange 49, for example, has an extra, projecting lug 52, and in addition there is a lug 53 similarly projecting from a tab 54. Symmetrical with the accurate lugs 52 and 53 are openings 56 and 57, each adapted accurately to receive one of the lugs. These interfit at assembly to ensure registry of the assembled plates.

Additionally, the plates have apertures 58 and 59 to receive through bolts, the aperture 59 being provided by an outstruck lug 61 which also serves as a spacer and support when it is in abutment with the adjacent plate. Additionally, there is provided an aperture 62 for a fastening, the aperture being bounded by a spacer lug 63 of half the thickness of the space 47 so as to abut a comparable lug when the plates are assembled. Further, there is an aperture 64 for a fastener. This is formed with a spacer rim 66 adapted to abut a comparable half height spacer rim on an adjacent plate. Also, each plate has an outstruck spacer tab 67 symmetrical with a pierced opening 68. When two plates are assembled, the tip of the tab 67 extends completely through the opening 68. The tab 67 has a reduced or weakened portion 69 so that after assembly the tab tip readily can be twisted as a permanent fastener.

Especially designed to be slidably assembled on the primary spindle 26 when the operator 16 is absent therefrom is a rocker lever 71. This lever is symmetrical about a median plane and includes a driven ring 72 having an opening therethrough of a size to accommodate the standard spindle 26. The ring 72 also has an inwardly projecting tooth 73 designed to fit in and slide along the spindle slot 27 and to transmit rotary force between the spindle and the rocker lever 71. The rocker lever also has a pair of lever arms 74 and 76 joined to the ring 72 by means of connectors 77 and 78 partially bounding an intervening arcuate aperture 79.

Cooperating with the rocker lever 71 is a slide 81 having shoes 82 and 83 along the edges thereof bearing against or sliding along the edge flanges 48 of the assembled plates 41 and 42. Preferably, the shoes 82 and 83 at their ends are rounded or have bevels 84 for smooth sliding.

To space the slide 81 slightly from large areas of the adjacent plates 41 and 42, each plate is provided with embossed bearing discs 86 formed in and outstanding in a small amount from the general plane of the plate. Even though there may be some slight distortion of the plates or of the slide 81, there is sufficiently smooth contact between them so that movement of the slide 81 with respect to the plates is always readily accomplished. This is particularly important since there are no springs in the present mechanism, the regular return springs standard in the lock mechanisms 19 and 21 being relied upon. Since the usual installation is as shown herein, gravity acting on the slide 81 serves normally to keep the slide in the position shown in FIG. 4 with two primary lugs 88 and 89 on the slide in abutment with the horizontally extending lever arms 74 and 76.

The slide 81 is cut away to clear adjacent mechanisms but is extended to provide a secondary lug 91 having an inclined face 92 thereon. Although it is not always provided, in the present instance the slide 81 also has a lug 93 abutting the edge flange and normally overlying or contacting one of the discs 86 to preserve the symmetrical guide and support arrangement between the slide and the adjacent plates.

In association with the secondary mechanism 21 and designed to cooperate with the secondary spindle 34, there is provided a rotary lever 96. Unlike the primary lever 71, the lever 96 is designed to be supported and located by bearing on the plates 41 and 42. For this reason the rotary lever 96 is conveniently made of two relatively thin sheets 97 and 98, as especially shown in FIG. 3, the sheets being, after forming, held in alignment by integral extruded pins 99. This construction permits the provision of integral, oppositely extending journals 101 and 102 rotatable in bearings 103 formed by the margins of the openings 46, thus supporting and centering the rotary lever for operation. The rotary lever includes cut-out portions 104 and 106 to coincide during rotation with the openings 58 and 59.

The journals 101 and 102 are pierced to provide noncircular openings 107 to receive and slide on the secondary spindle 34 and to make the rotary lever nonrotatable with respect thereto.

The cartridge is assembled with the rocker or primary lever 71, the slide 81 and the rotary lever 96 in position against one plate 41. The identical plate 42 is superposed with the various lugs 52 interfitting with the holes 56 and the lugs 53 interfitting with the holes 57. The projections 67 pass through the openings 68, and the edge flanges 48, 49 and 51 define the sides of the then-enclosed space 47. The journals 101 and 102 seat on the edges of the openings 46 and the ring 72 is approximately aligned with the openings 44. When such an assembly has been made, the lugs 67 are both twisted so that the assembly is secured.

If they are not already in place, the deadbolt lock mechanism 21 is introduced into the prepared bore 111 in the door panel 6, as usual, and the latchbolt mechanism 19 is similarly introduced into a prepared bore 112 in the door panel. At this time neither of the operators 16 nor 18 is in place. The primary spindle 26 projects from the interior side of the panel, as does the secondary spindle 34. At this juncture, and giving heed to the hand of the installation, the assembled cartridge is threaded over the primary spindle 26 and the secondary spindle 34. The ring 72 is arranged over the spindle so that the tooth 73 slides along in the groove 27. Simultaneously, the openings 107 slide along the secondary spindle 34.

As the cartridge is moved toward the door panel, the appropriate one of a pair of symmetrical beveled surfaces 113 and 114 in the plates (FIGS. 3 and 9) slides over and momentarily depresses the detent 29, and the cartridge is moved substantially flush against the face 6 of the door panel. The detent 29 springs out when the cartridge is in its final position. The cartridge can lie flush against the panel despite the projection of the twist lugs 67, since the leading lug is disposed within the bore 112.

When the cartridge has been so positioned, the usual fastening screws 116 are introduced and are tightened against and in their standard lock mechanisms 19 and 21, thus holding the cartridge against the door panel and making a firm assembly. The screws can be tightened substantially, since adjacent the places they go through the cartridge the cartridge is positioned and stiffened by the upstanding spacers such as 61, 63 and 66. The cartridge plates do not bind on, but leave the slide and interior parts quite free to operate.

While the actuators 16 and 18 could be mounted at this point, it is preferred to provide a decorative escutcheon 121 over the cartridge. The escutcheon is a dished plate with flanges 122 therearound adapted to surround the cartridge. To receive and hold the escutcheon in place, the plate 41 has at its top a bent lug 123 which twins with the lug on the adjacent plate 42 to provide a locating device for a central hook in the top flange 122. The escutcheon is hung thereon. Since the escutcheon also supports the operator 18 for rotation, care is taken as the escutcheon is initially hooked and swung into position to make the proper interengagement between the secondary spindle 34 and the operator 18. The escutcheon has a lower apertured boss 127 which slips over the projecting primary spindle 26.

To hold the escutcheon in place there is provided a spring-pressed catch lug 128 at the bottom of the cartridge. The lug 128 is a portion of a slide 129 having notches 131 engaging the lugs 53 on the individual plates 41 and 42. The slide 129 abuts against a spring wire 133 extending transversely and held in position against tabs 134 projecting from the plates 41 and 42. There is an opening 136 in the bottom of the escutcheon. The parts are assembled by sliding the escutcheon flange 122, at the bottom, over the beveled lug 128. This momentarily lifts against the urgency of the spring 133 and then enters the opening 136 when the escutcheon is in place. The parts can be disassembled by reverse motions, the spring-pressed lug 128 first being forced upwardly by any convenient tool.

Following the mounting of the escutcheon, the primary operator 16 is urged over the primary spindle 26, the leading edge of the shank 32 camming over the detent 29 in the normal fashion, the detent springing into the standard opening 31 in the shank as soon as the operator is properly oriented.

There has thus been provided an arrangement including two standard lock mechanisms 21 and 19 and two standard operators 16 and 18 with an appropriate interior escutcheon 121 housing a mechanical interconnection between the spindles.

Figure 4:
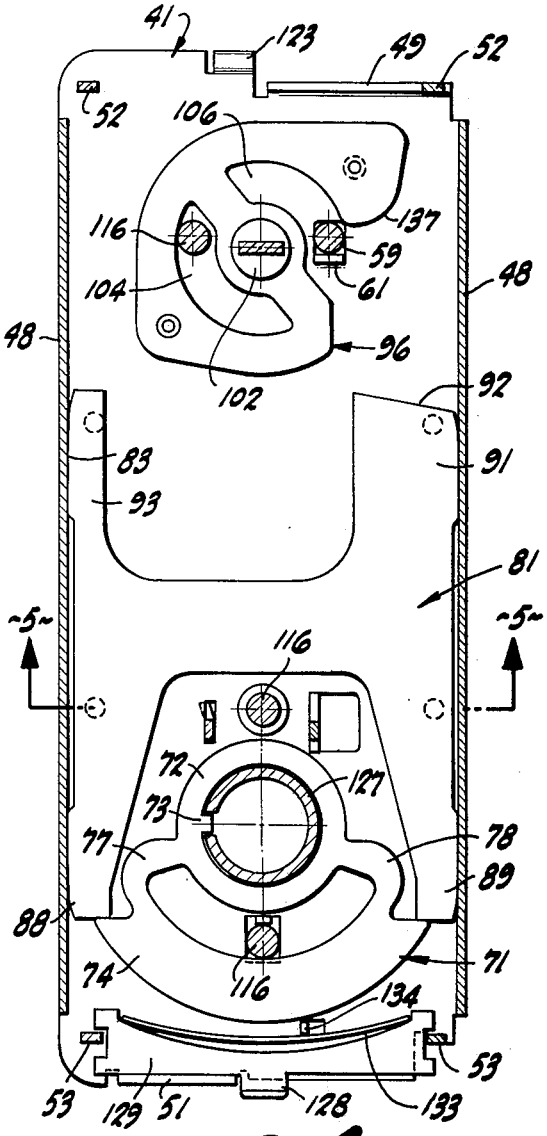
FIG. 4 is a cross-section, the plane of which is indicated by the line 4—4 of FIG. 2.
Figure 5:
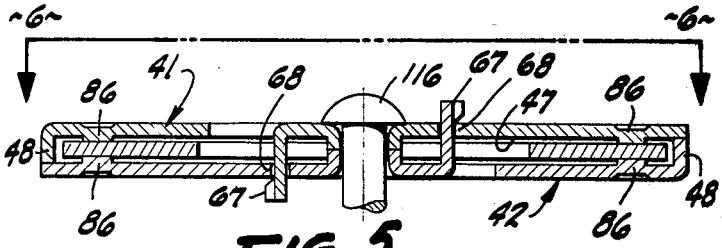
FIG. 5 is a cross-section, the plane of which is indicated by the line 5—5 of FIG. 4.
Figure 6:
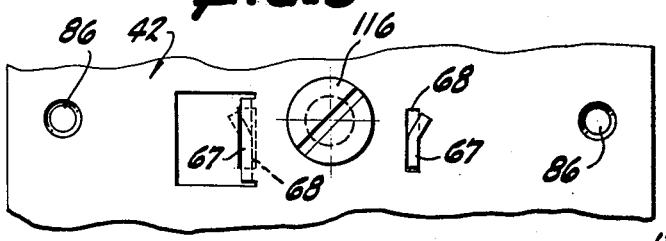
FIG. 6 is a partial elevation, portions being broken away, adjacent one of the fastening means, the plane of the view being indicated by the line 6—6 of FIG. 5.

With this assembly, the parts are normally at rest in the position shown in FIG. 4. The operator 18 can be rotated in one direction to project or oppositely to retract the deadbolt 13 without difficulty and without disturbing any other mechanism. There is no consequential additional load put on any of the return spring mechanism of the lock device 21. Also, the primary operator 16 can be rotated either way from center. This operates the latchbolt as usual and also rotates the rocker lever 71, which in turn lifts and allows lowering of the slide 81. The slide lifting and lowering is the same no matter what direction the rocker lever 71 is turned, since the parts are symmetrical. Rotation of the lever 71 and lifting the slide 81 does impose a greater load on the spring return of the mechanism 19, but this load is relatively light and standard springs are still usable.

Figure 7:
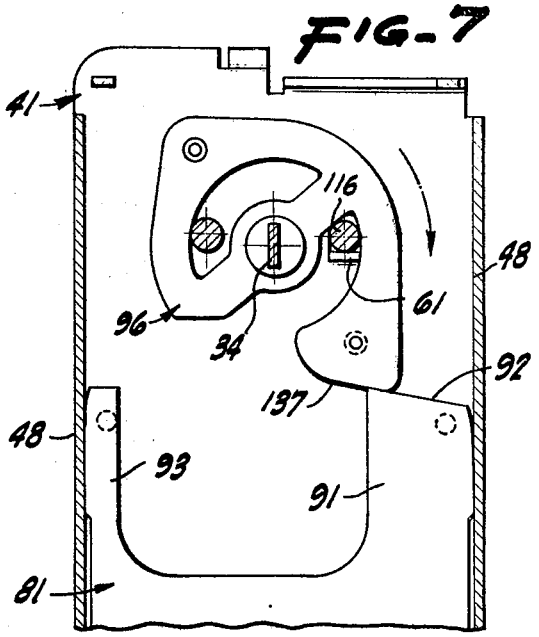
FIG. 7 is a view of the upper portion of the mechanism shown in FIG. 4 but with the secondary spindle in a different, extreme position.
Figure 8:
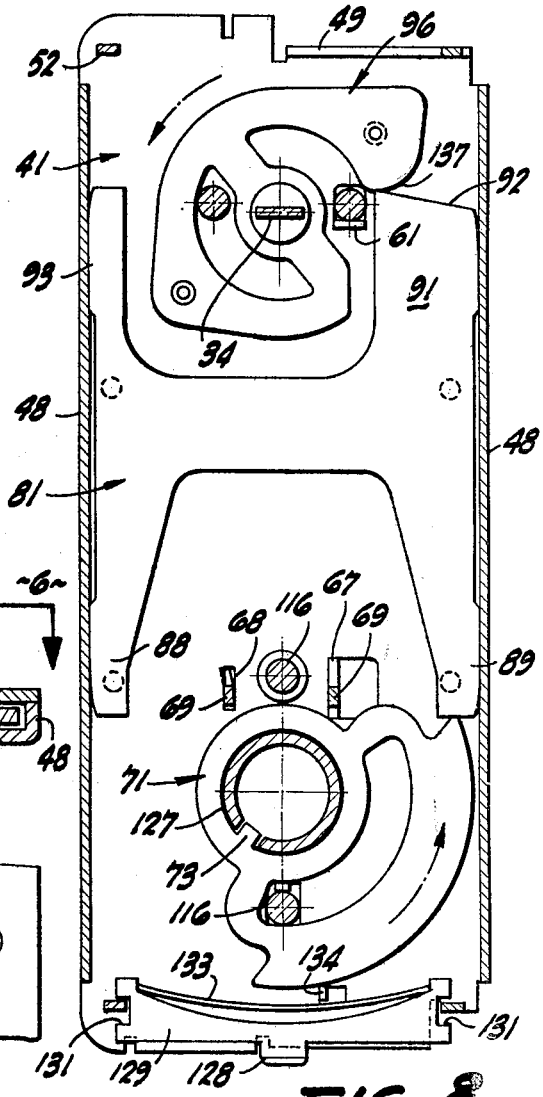
FIG. 8 is a view comparable to FIG. 4 but showing the slide in a different location.

When the operator 18 has been turned to project the deadbolt 13, it occupies a position as shown in FIG. 7, the cam face 137 of the rotary lever 96 lying against or being close to the inclined face 92 of the slide. Whenever the primary operator 16 is rotated in either direction and the slide 81 is lifted, the lifting movement produces a counterclockwise rotation of the rotary lever 96, that lever moving from the position shown in FIG. 7 into the position shown in FIG. 8. In the process the secondary spindle 34 is rotated to retract the latchbolt 12. Thus, retraction of the latchbolt under the stated condition is accompanied by retraction of the deadbolt, thus affording a panic-proof feature by completely unlocking the door panel merely by the rotation of the control 16. This feature has been provided by the addition of the cartridge and without changing any of the standard lock mechanisms 19 and 21.

Upon initial installation of the cartridge, the positioning is such that the directions of rotation are appropriate for the particular hand of door involved. If it should turn out that the hand of the door is to be changed or if the cartridge mechanism is to be reinstalled on a door of opposite hand, then it is merely necessary to turn the separate cartridge over about its longitudinal axis 43 and reinstall it as described. Since the cartridge is symmetrical, there is no necessity to take the plates 41 and 42 apart nor to alter or reposition any of the interior parts.

I claim:

1. A cartridge for a lockset having a lock mechanism with a primary rotatable spindle and a secondary rotatable spindle comprising a first cartridge plate, a second cartridge plate substantially identical in size and shape to said first cartridge plate, each plate having flange means on only a portion of its periphery extending to and abutting an unflanged edge portion of the other plate, means securing said cartridge plates directly to each other in registry and spaced apart by said flange means to provide a predetermined space therebetween, means defining openings in said first and said second cartridege plates disposed on a common center line for receiving said primary spindle and said secondary spindle, a rocker lever including lever arms adapted to be mounted on and rotatable with said primary spindle and located in said space between said cartridge plates with said lever arms on opposite sides of said center line, a slide including a pair of projecting primary lugs at one end and a projecting secondary lug at the other end, said slide being guided in said space by said flange means between said cartridge plates with said primary lugs in position to be engaged by said lever arms, a rotary lever located in said space between and journalled on said cartridge plates in rotary driving engagement with said secondary spindle, and a lever arm included with said rotary lever and in engagement with said secondary lug.

2. A device as in claim 1 including means defining an arcuate aperture in said rocking lever, and means including a fastener extending through said first cartridge plate and said second cartridge plate and through said arcuate aperture into said lock mechanism for securing said cartridge plates to said lock mechanism.

3. A device as in claim 1 in which said primary spindle is tubular with an axially extending slot, and said rocker lever includes a lug adapted to slide in said slot.

4. A device as in claim 1 in which said primary spindle includes a radially moving, spring-pressed detent projecting therefrom; and at least one of said cartridge plates adjacent said primary spindle receiving means includes a cam adapted to engage and move said detent radially against said spring urgency during axial movement of said cartridge plates along said primary spindle.

5. A device as in claim 4 in which said cartridge is axially receivable over said spindles with either of said plates in the lead.

6. A device as in claim 4 including means in said space between said cartridge plates for precluding the radial entry into said space of said detent as said cartridge plates move axially over and along said primary spindle.

* * * * *